United States Patent [19]

Connolly et al.

[11] 4,303,067

[45] Dec. 1, 1981

[54] MEDICAL LIQUID BAG HAVING AN IMPROVED ADDITIVE PORT

[75] Inventors: Terry Connolly, Aukland, New Zealand; Milton L. Patrick, Lake Forest, Ill.; Thomas E. Rudolph, Mission Viejo, Calif.; Alan Stanley, Aukland, New Zealand

[73] Assignee: American Hospital Supply Corporation, Evanston, Ill.

[21] Appl. No.: 113,930

[22] Filed: Jan. 21, 1980

[51] Int. Cl.[3] ..... A61J 1/00

[52] U.S. Cl. ..... 128/272; 128/DIG. 24; 215/247; 150/8

[58] Field of Search ..... 150/1, 8; 128/272, DIG. 24, 128/214 D, 214.2; 215/247, 248, 249

[56] References Cited

U.S. PATENT DOCUMENTS

| | | | |
|---|---|---|---|
| Re. 25,129 | 2/1962 | Walter | 128/214 |
| 2,838,046 | 6/1958 | Butler | 128/272 |
| 3,064,652 | 11/1962 | Corcoran et al. | 128/272 |
| 3,215,299 | 11/1965 | Coanda et al. | 128/272 |
| 3,325,031 | 6/1967 | Singier | 128/272 |
| 3,327,709 | 6/1967 | Nehring et al. | 128/214 |
| 3,394,831 | 7/1968 | Bathish et al. | 128/272 |
| 3,509,879 | 5/1970 | Bathish et al. | 128/214 |
| 3,986,506 | 10/1976 | Garber et al. | 128/214 D |
| 4,137,117 | 1/1979 | Jones | 156/294 |

FOREIGN PATENT DOCUMENTS

| | | | |
|---|---|---|---|
| 180949 | 9/1977 | New Zealand . | |
| 558998 | 1/1944 | United Kingdom | 215/247 |
| 1428373 | 3/1976 | United Kingdom | 128/214 D |

*Primary Examiner*—Robert W. Michell
*Assistant Examiner*—J. L. Kruter
*Attorney, Agent, or Firm*—Richard L. Myers

[57] ABSTRACT

A flexible bag for dispensing medical liquid, such as intravenous solutions, to a patient. The bag has an improved additive port for periodically injecting medication or other liquid into the bag through a puncturable, resealable plug. The additive port includes a flexible support tube segment sealed between opposed walls of the bag and a substantially stiffer puncture tube sealed to an outer end of a port tube segment, which substantially stiffer puncture tube is in turn sealed to a tear-off closure. A puncturable, resealable plug is held against an integral puncturable (nonresealable) diaphragm of the puncture tube by the retaining member sealed within the puncture tube. This construction provides more reliable, leak proof sealing between components of an additive port of a medical liquid bag.

15 Claims, 5 Drawing Figures

FIG. 1
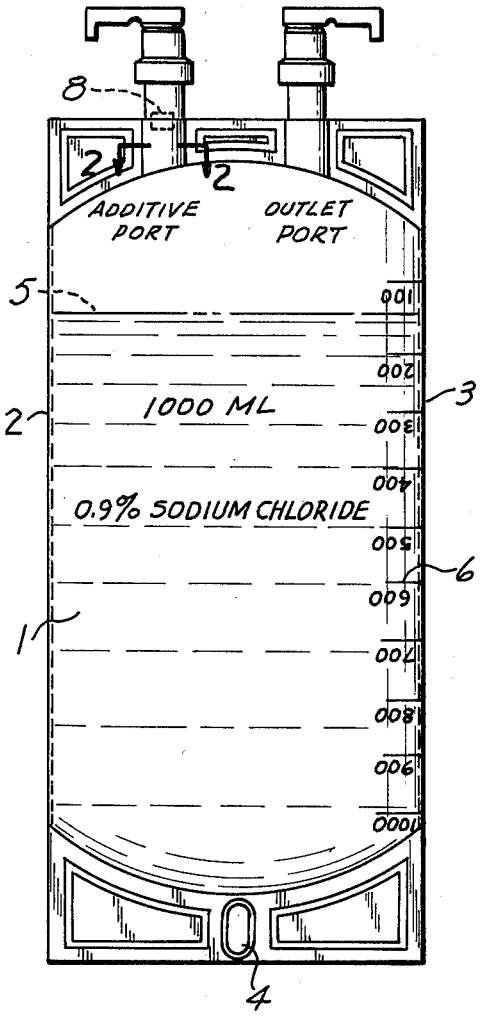
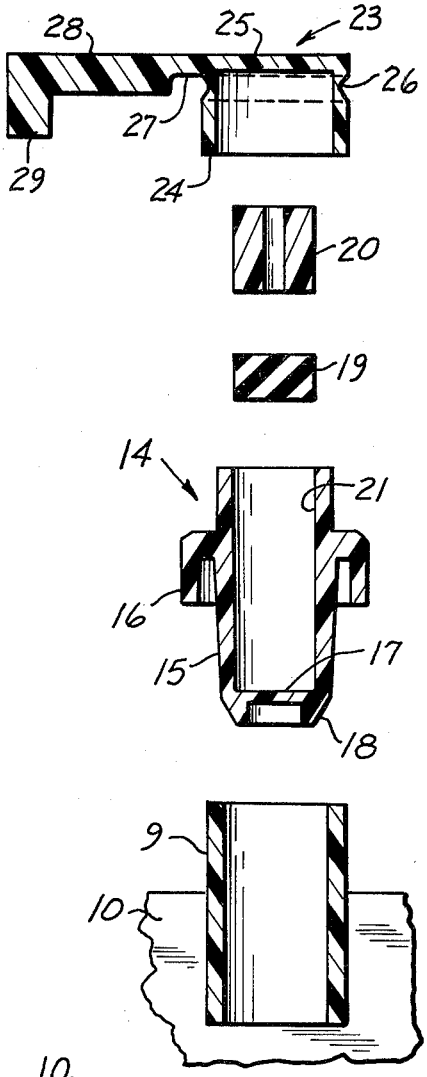
FIG. 3
FIG. 2
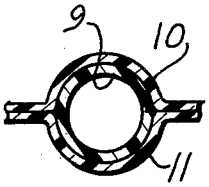
FIG. 4
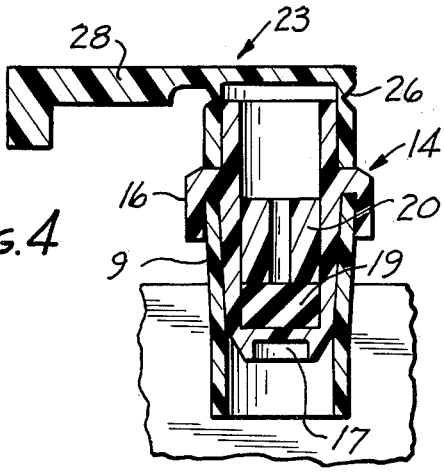
FIG. 5
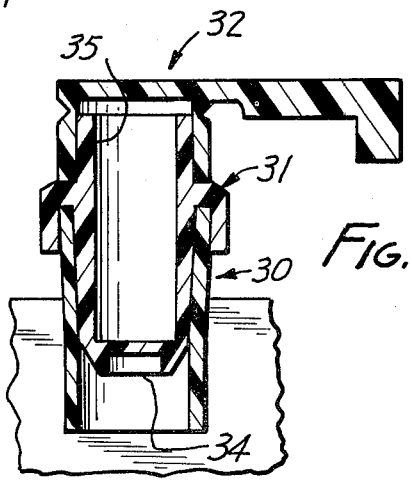

MEDICAL LIQUID BAG HAVING AN IMPROVED ADDITIVE PORT

BACKGROUND

It is well-known to collect, store, and administer blood from a flexible bag. The Walter U.S. Pat. No. Re. 25,129 discloses such a system in which a blood bag port has a short tube segment with an integral diaphragm 16a (FIG. 3) which is punctured to gain entrance into the bag. The short tube segment has its sterility protected by a pair of opposed peal apart tabs. The tube segment of this patent is made of a thermoplastic material with an integral thermoplastic diaphragm extending across its passage. Such construction is fine for blood bags in that usually a port system is entered only once to either select blood in the bag or dispense it. Thus, a thermoplastic diaphragm need not be "resealable" after removal of the puncture spike.

With flexible bags that are used to dispense intravenous solutions, such as saline, dextrose, etc., it is sometimes required to periodically inject into the bag additive medication either prior to or during the administration of such solution to the patient. Since there are repeated injections through an additive port, it is necessary that the additive port reseal after removal of the injecting device, which often is a hypodermic syringe. U.S. Patents such as U.S. Pat. Nos. 2,838,046 and 3,064,652 have proposed the use of a puncturable, resealable rubber plug secured to the wall of a medical liquid bag. Both of these patents have used a flanged support to seal the rubber plug directly to the face surface of the medical liquid bag. This construction has a disadvantage in that the rubber plug had to be sealed to flat sheet material that was then subsequently folded and sealed on three sides to form a bag. The folded edge is shown as 17 in U.S. Pat. No. 2,838,046 and at numeral 3 in U.S. Pat. No. 3,064,652.

New Zealand Pat. No. 180,949 describes a medical liquid bag currently being marketed in New Zealand where it is commonly known as the Dutch Red Cross (DRG) blood bag. The bag described in this New Zealand patent has a thin walled, flexible tube with an integral thermoplastic diaphragm 32 against which fits a puncturable, resealable plug 34. A substantially more rigid section 47 urges the plug against diaphragm 32, which is not resealable. The actual manufactured DRG bag sold in New Zealand, item 47 which holds in the plug 34, is an extruded segment of tubing sealed within a tube 22, across which is formed integral diaphragm 32. The entire puncture port system is then sealed between two opposed walls of the bag, such as shown in FIG. 4. A portion of the sealed bag walls is ripped apart to remove a tab section formed of the bag walls directly above the puncture port. This tear line extends across approximately one half the width of the DRG bag.

Such bag construction, such as shown in FIG. 6 of this New Zealand patent, can cause problems in forming a reliable, leak proof seal between the tubular element and the two opposed bag walls. This is because the thin, flexible lower portion of the puncture port absorbs a different amount of heat than the stiffer, more rigidified section at the upper portion of the port during sealing procedure. Also, sometimes it is difficult to get a proper seal between a very thin wall section of the bag and the tubular segment located between the bag walls that has a substantially greater wall thickness. Once the wide tabs have been torn off to expose the puncture port of the New Zealand bag, it is extremely critical that the seal along edges of the tubular puncture system remain intact, and no liquid seepage can exit the bag at the seal between the bag wall and the puncture port system.

SUMMARY OF THE INVENTION

The present invention overcomes the above problems with additive ports in flexible medical liquid bags. The invention includes a support tube which preferably is an extruded length of tubing which can have a relatively thin wall and the be very firmly and reliably secured to the opposed bag walls and extend outwardly from the walls where it is securely bonded to a substantially more rigid puncture tube, which has an integral, transverse diaphragm against which fits a puncturable, resealable plug secured by a retainer member within the puncture tube. An outer tear-off closure seals the puncture tube until access to the additive port is required.

THE DRAWINGS

FIG. 1 is a front elevational view of the medical liquid bag containing an intravenous solution;

FIG. 2 is an enlarged sectional view taken along line 2—2 of FIG. 1;

FIG. 3 is an enlarged exploded view of the additive port construction of FIG. 1;

FIG. 4 is an enlarged sectional view of the additive port construction; and

FIG. 5 is an enlarged sectional view of the outlet port construction.

DETAILED DESCRIPTION

In FIG. 1, a medical liquid bag 1 is shown with a pair of opposed walls. Preferably, this bag is formed of extruded, lay flat tubing so there is no need for seams at edges 2 and 3. The bag is shown with its additive and outlet port structures sealed between opposed walls at one end of the bag. A hanging aperture 4 is at an opposite end of the bag. When administering the parenteral liquid 5 in the bag to a patient, the bag is inverted from the position shown in FIG. 1. Thus, volumetric calibrations designated as 6 are readable. For clarity of FIG. 1, the indicia "additive port" and "outlet port," as well as the bag's total volume and contents (1,000 ml of 0.9% sodium chloride) has been shown on the bag in a manner inverted to their actual position.

As previously mentioned, it is very important to have a puncturable, resealable diaphragm in one port of an intravenous solution bag so that injections of additive medication can be made many times into the same bag. The puncturable, resealable diaphragm designated as 8 is firmly secured within the additive port structure. The additive port structure includes a support tube 9 sealed between opposed wall portions 10 and 11 of the medical liquid bag. It is very important to get a firm seal at the place where the two bag wall portions meet at the periphery of support tube 9. This is why support tube 9 is preferably of a wall thickness sufficiently thin to provide a certain flexibility (but not total collapse) to the support tube so that any variance in the extruded tube section 9, the variance in heat applied during sealing, etc. can be tolerated by the slightly flexible support tube 9.

FIG. 3 shows support tube 9 with bag wall portion 11 removed to show the relationship between support tube 9 and wall portion 10 of the bag. A puncture tube shown generally at 14 is preferably an injection molded thermoplastic part in which much closer tolerances can be observed than with the generally cylindrical support tube 9. Also, with the injection molded puncture tube 14, a tapered external surface 15 and a sealing flange 16, as well as an integral puncturable (nonresealable) diaphragm 17 can be integrally formed with the part. A more steeply tapered lead-in section 18 can also be included to help guide the puncture tube within the support tube 9. The puncturable, resealable plug 19, preferably of a rubber material, is held against diaphragm 17 by a retaining tube 20 which is bonded directly to a generally cylindrical inner surface 21 of puncture tube 14. Both retaining tube 20 and support tube 9 can be extruded in a generally cylindrical shape.

An outer tear-off closure designated generally at 23 includes a depending skirt section 24 on a cap member that includes a top wall 25 integrally formed with skirt 24 and adapted to separate from the skirt along a peripheral groove 26. A weakened portion 27 at a handle 28 permits handle 28 to be hinged upwardly for a better grip when manually tearing apart the tear-off closure at groove 26. A lug 29 on the handle also helps in securing a firmer, manual grip on the handle.

FIGS. 4 and 5 show the configuration of the additive and outlet ports, respectively. Here it can be seen that the puncture tube 14 is firmly sealed, preferably by a solvent seal, to the support tube 9. The substantially, more rigid puncture tube 14 provides the very important seal under accurate dimensions between the rubber plug 19 and the puncture tube. It should be recognized that once thermoplastic diaphragm 17 is punctured by a hypodermic needle which is subsequently removed from the additive port, diaphragm 17 can no longer seal against liquid seepage from the bag. Thus, it is highly critical that rubber plug 19 not have any leaks about its periphery at its joint to the puncture tube 14.

Also, because of the tolerance variation at the critical seal between support tube 9 and the opposed bag walls 10, 11, support tube 9 being substantially more flexible than puncture tube 14 can absorb these tolerances. By having the more flexible support tube 9 inserted and sealed to the bag wall, it can provide a firm anchor for the more rigid puncture tube 14 which is secured to this port tube at an easily controllable location outside the bag by means of a solvent seal between flange 16 and an upper end of support tube 9.

In FIG. 5, the outlet port is shown which includes a support tube 30 secured to a puncture tube 31, which is in turn secured to a tear-off closure shown generally at 32. A puncturable (nonresealable) diaphragm 34 can receive a puncture spike and an inner wall 35 can seal against an external surface of the spike. Preferably, this inner wall has a restriction such as shown in the Bathish et al U.S. Pat. No. 3,509,879 mentioned previously. However, it should be understood that once the spike has been removed, there is no resealing plug to prevent liquid draining out of the outlet port. With intravenous solution containing bags, the outlet port is primarily punctured with a large diameter plastic spike, wherein the additive rubber plug containing port is generally punctured by a stainless steel hypodermic needle attached to a hypodermic syringe.

The outlet port system substantially as shown in FIG. 5 has previously been used for both an inlet port and an outlet port on a blood bag in which both the inlet and outlet ports were punctured by a large diameter thermoplastic spike. There was no resealing or additive port connected with the blood bag. Nor was there any recognition of the importance and structure of sealing the rubber plug in a separately formed puncture tube secured to a more flexible support tube that is bonded between two opposed walls of an I.V. solution bag. The blood bag described in this paragraph has been marketed in the United States by McGraw Laboratories for several years.

In the foregoing description, a specific example has been used to describe the invention. However, it is understood by those skilled in the art that certain modifications can be made to this example without departing from the spirit and scope of the invention.

We claim:

1. A medical liquid bag with a pair of opposed walls, wherein the improvement comprises: a support tube sealed between the opposed walls and extending outwardly beyond the walls; a puncture tube with an inner portion fitting within the support tube and an outer portion extending outwardly beyond the support tube; a diaphragm integral with the puncture tube closing off a passage to the puncture tube; a puncturable resealable plug in the passage of the puncture tube; a retainer tube means sealed to the puncture tube to urge the plug toward the diaphragm; and a tear-off closure sealed to the outer portion of the puncture tube.

2. A medical liquid bag as set forth in claim 1, wherein the support tube is of extruded thermoplastic which is substantially more flexible than the puncture tube.

3. A medical liquid bag as set forth in claim 2, wherein the support tube is substantially cylindrical.

4. A medical liquid bag as set forth in claim 1, wherein the puncture tube is of an injection molded thermoplastic with an intergral thermoplastic diaphragm.

5. A medical liquid bag as set forth in claim 4, wherein the puncture tube has a tapered external surface for wedgingly fitting into the support tube.

6. A medical liquid bag as set forth in claim 1, wherein the puncture tube has an external flange fitting over an end of the support tube.

7. A medical liquid bag as set forth in claim 1, wherein the tear-off closure has a peripheral groove, a laterally extending handle, and a lug disposed on the handle.

8. A medical liquid bag as set forth in claim 1, wherein the retainer is a thermoplastic tube sealed to the puncture tube and holds the plug in direct contact with the diaphragm.

9. A medical liquid bag as set forth in claim 1, wherein the port system described in claim 1 is for injecting additive medication into the bag; and the bag also has an outlet port system for connecting to a tubular spike of an administration set, said outlet port system comprising: a second support tube sealed between the opposed walls; a second puncture tube with an inner portion fitting within the second support tube and an outer portion extending outwardly beyond the second support tube; a second diaphragm integral with the second puncture tube closing off a passage through such second puncture tube; and a second tear-off closure sealed to the outer portion of the second puncture tube.

10. A medical liquid bag as set forth in claim 9, wherein the bag is at least partially filled with an intravenous solution.

11. A medical liquid bag as set forth in claim 9, wherein the bag has indicia thereon showing that one port gives an additive port and the other port gives an outlet port.

12. The medical liquid bag set forth in claim 1 wherein the diaphragm is integral with the puncture tube and is disposed to seal the passage defined by the puncture tube and the support tube.

13. A medical liquid bag having a pair of opposed walls, wherein the improvement comprises:

a support tube having an outer surface and an inner surface, the outer surface being sealed between the opposed walls of the bag with portions of the support tube extending outwardly beyond the opposed walls of the bag;

a puncture tube sealingly engaging the support tube and having an inner surface defining with the inner surface of the support tube a passage extending interiorly of the bag;

a puncturable diaphragm disposed within the passage and sealingly engaging the inner surface of the passage;

a puncturable, resealable plug disposed within the passage in proximity to the diaphragm and sealingly engaging the inner surface of the passage; and a retainer means disposed in the passage for urging the plug toward the diaphragm and for maintaining the plug in proximity to the diaphragm.

14. The medical liquid bag recited in claim 13 wherein the support tube is formed from a first material, the puncture tube is formed of a second material, and the first material is relatively more flexible than the second material.

15. The medical liquid bag recited in claim 13 wherein the plug is disposed outwardly of the diaphragm, and the retainer is disposed outwardly of the plug along the longitudinal axis of the support tube.

* * * * *